US012599812B2

(12) United States Patent
Han et al.

(10) Patent No.: US 12,599,812 B2
(45) Date of Patent: Apr. 14, 2026

(54) COMPREHENSIVE MULTIFUNCTIONAL FITNESS CABINET

(71) Applicant: Beijing Yihai Technology Co., Ltd., Beijing (CN)

(72) Inventors: Yunhai Han, Beijing (CN); Anqi Gong, Nanping (CN); Hao Tian, Renqiu (CN)

(73) Assignee: Beijing Yihai Technology Co., Ltd., Beijing (CN)

( * ) Notice: Subject to any disclaimer, the term of this patent is extended or adjusted under 35 U.S.C. 154(b) by 62 days.

(21) Appl. No.: 18/679,986

(22) Filed: May 31, 2024

(65) Prior Publication Data

US 2025/0303230 A1 Oct. 2, 2025

(30) Foreign Application Priority Data

Mar. 28, 2024 (CN) ..... 202410370053.6
Mar. 28, 2024 (CN) ..... 202420625432.0

(51) Int. Cl.
*A63B 23/12* (2006.01)
*A45C 5/14* (2006.01)
*A45C 13/00* (2006.01)

(52) U.S. Cl.
CPC ..... *A63B 23/1218* (2013.01); *A45C 5/141* (2013.01); *A45C 13/001* (2013.01)

(58) Field of Classification Search
CPC .... A63B 23/1218; A45C 5/141; A45C 13/001
See application file for complete search history.

(56) References Cited

U.S. PATENT DOCUMENTS

| | | | | |
|---|---|---|---|---|
| 12,208,303 | B2 * | 1/2025 | Leavitt | A63B 71/0036 |
| D1,085,294 | S * | 7/2025 | Tseng | D21/690 |
| 2019/0166993 | A1 * | 6/2019 | Siaperas | A47B 81/00 |
| 2019/0240528 | A1 * | 8/2019 | Donnelly | A63B 21/4029 |
| 2024/0316393 | A1 * | 9/2024 | Muth | A63B 71/0622 |

FOREIGN PATENT DOCUMENTS

CN 217745540 U * 11/2022

* cited by examiner

*Primary Examiner* — Andrew M Kobylarz
(74) *Attorney, Agent, or Firm* — JEEN IP LAW, LLC

(57) ABSTRACT

The present invention relates to the technical field of comprehensive multifunctional fitness cabinets, and in particular to a comprehensive multifunctional fitness cabinet comprising a box having a storage slot on a top thereof; and a seat assembly comprising a backing plate movably connected to the storage slot, and a seat plate movably connected to the storage slot; and a movement assembly comprising a bracket and a pull cord connected to the bracket, a resistance member being connected to an end of the pull cord; and a support assembly used to connect the box and the seat assembly; wherein the seat assembly, the movement assembly and the support assembly can all be stored in the storage slot, effectively solving a problem in the prior art that storage is difficult after fitness is completed.

9 Claims, 7 Drawing Sheets

COMPREHENSIVE MULTIFUNCTIONAL FITNESS CABINET

CROSS-REFERENCE TO RELATED APPLICATIONS

This is a U.S. patent application which claims the priority and benefit of Chinese Patent Application Number 202410370053.6, filed on Mar. 28, 2024 and 202420625432.0, filed on Mar. 28, 2024, the disclosure of which is incorporated herein by reference in its entirety.

TECHNICAL FIELD

The present invention relates to the technical field of fitness cabinets, in particular to a comprehensive multifunctional fitness cabinet.

BACKGROUND

With the improvement of people's living standards and the enhancement of health awareness, many people will perform fitness exercises, such as sit-ups, dumbbell weight-lifting, etc., which can not only enhance abdominal strength, but also exercise a cardiopulmonary function to achieve the effect of strengthening the body.

A fitness cabinet is a kind of fitness auxiliary equipment. It is often used to assist in completing some necessary fitness movements, such as: incline dumbbell bench press, decline dumbbell bench press, chest clamping, fly and rowing and other targeted fitness movements. Rowing is a kind of fitness equipment with a purpose of fitness exercise and used to simulate water rowing, and has a good effect on strengthening muscles of the legs, waist, upper limbs, chest and back. With each stroke, the upper limbs, lower limbs, waist and abdomen, and back will complete a complete contraction and extension during the process. The fly movement is usually done in a gym. People can exercise shoulder and chest muscles through pull-down and chest clamping movements. Most fly and rowing training machines require a large floor area and are often unable to be stored. This causes a huge waste of space when idle. If they are used in fitness scenarios such as homes and offices, the idle equipment will also affect people's normal work and life. In addition, traditional dumbbell benches can only complete simple arm strength training, and it is difficult for leg and chest muscle training to achieve results. To this end, we address the above issues and propose a comprehensive multifunctional fitness cabinet.

SUMMARY

In order to solve the above technical problems, the present invention provides the following technical solution: a comprehensive multifunctional fitness cabinet, sitting on a box. By pulling a pull rod, a pull cord pulls webbing to generate resistance, and the training of pull-down and chest-clamping movements can be completed. The comprehensive multifunctional fitness cabinet comprises the box, having a storage slot on a top thereof, and

- a seat assembly comprising a backing plate movably connected to the storage slot and a seat plate movably connected to the storage slot; and
- a movement assembly comprising a bracket and a pull cord connected to the bracket, and a resistance member being connected to an end of the pull cord; and

- a support assembly used to connect the box and the seat assembly;
- wherein the seat assembly, the movement assembly and the support assembly can all be stored in the storage slot.

As a preferred solution of the comprehensive multifunctional fitness cabinet of the present invention, wherein the movement assembly further comprises a mounting base disposed in the storage slot, the mounting base is rotatably connected to an end of the bracket, a telescopic rod is rotatably connected to a top of the bracket, the telescopic rod is of a hollow structure, which can be disposed in a vertical state and a horizontal state and be provided with a wire wheel.

As a preferred solution of the comprehensive multifunctional fitness cabinet of the present invention, wherein the resistance member comprises a connecting frame connected to the mounting base, a guide wheel set connected to the connecting frame, and webbing wound around the guide wheel set, one end of the pull cord passes through an inner cavity of the telescopic rod and is connected to a holding member through the wire wheel, and the other end of the pull cord is connected to the webbing.

As a preferred solution of the comprehensive multifunctional fitness cabinet of the present invention, wherein the support assembly comprises a slide block disposed at a bottom of the seat plate and a slide rail disposed at a bottom of the storage slot, and the seat plate is slidably connected to the storage slot through cooperation of the slide block and the slide rail.

As a preferred solution of the comprehensive multifunctional fitness cabinet of the present invention, wherein the support assembly further comprises connecting rods disposed symmetrically on both sides of a side wall of the backing plate and rotatably connected to the backing plate, and a crossbar is connected between ends of the two connecting rods.

As a preferred solution of the comprehensive multifunctional fitness cabinet of the present invention, wherein a plurality of positioning openings are disposed on a top of the slide rail, and the crossbar can be embedded in the positioning openings.

As a preferred solution of the comprehensive multifunctional fitness cabinet of the present invention, wherein the seat assembly further comprises legs, and the legs are disposed at a bottom of one end of the seat plate away from the box and are rotatably connected to the seat plate.

As a preferred solution of the comprehensive multifunctional fitness cabinet of the present invention, wherein the holding member is a segmented pull rod and a pull ring, and the pull rod and pull ring are both covered with anti-slip covers.

As a preferred solution of the comprehensive multifunctional fitness cabinet of the present invention, wherein both sides of the box are provided with a storage cavity, and a storage rack is disposed in the storage cavity, in which a dumbbell, the pull rod and the pull ring can be accommodated.

As a preferred solution of the comprehensive multifunctional fitness cabinet of the present invention, wherein a bottom of the box is provided with feet and moving wheels, and the feet are distributed at four corners of the bottom of the box.

The present invention has beneficial effects: when the comprehensive multifunctional fitness cabinet provided by the present invention is stored, the telescopic rod can be rotated, the bracket can be rotated around the mounting base to store the entire movement assembly in the storage slot, and the seat assembly can be stored through the support assembly, thus improving the portability of the fitness cabinet.

BRIEF DESCRIPTION OF DRAWINGS

In order to explain the technical solutions of the embodiments of the present invention more clearly, drawings required to be used in the description of the embodiments will be briefly introduced below. Obviously, the drawings in the following description only show some embodiments of the present invention. For persons of ordinary skill in the art, other drawings can also be obtained without exerting creative efforts according to these drawings. Wherein.

DETAILED DESCRIPTION OF THE EMBODIMENTS

Figure 1:
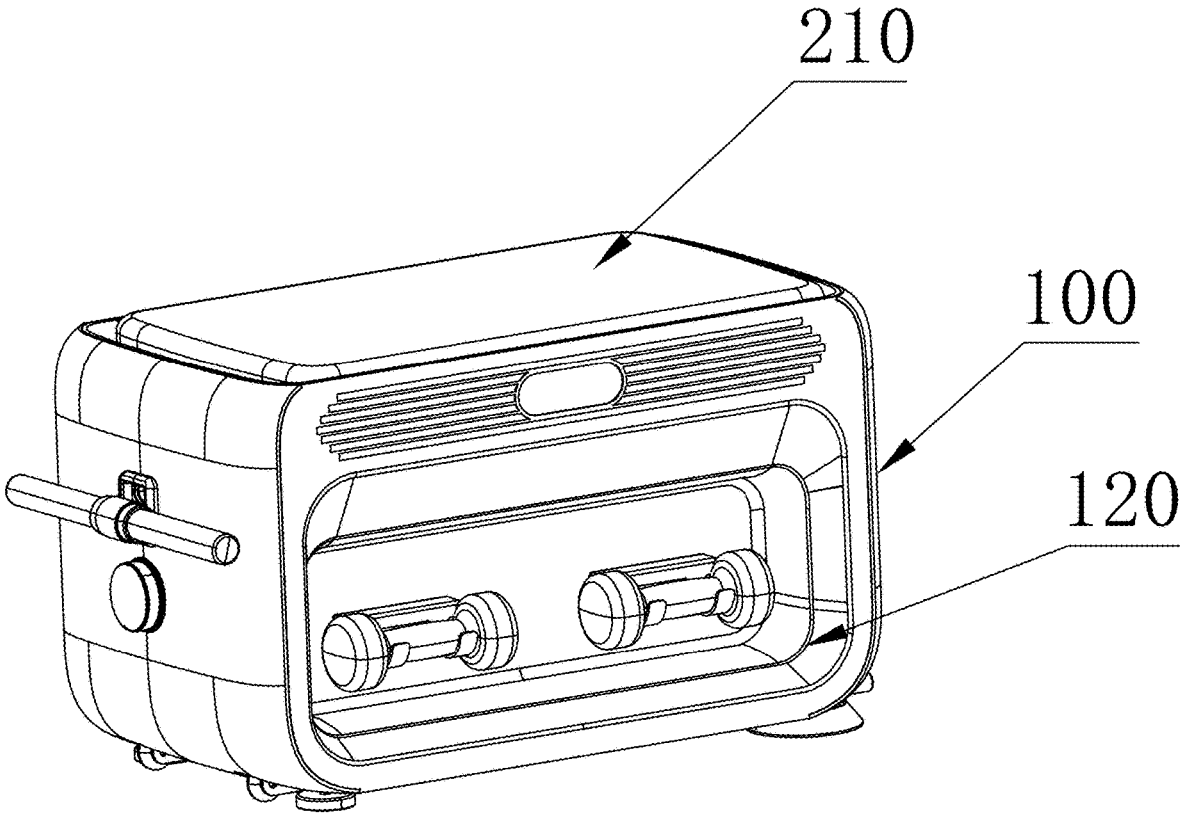
FIG. 1 is a schematic diagram of a storage state of an overall structure in the present invention.

In order to make the above objects, features and advantages of the present invention more obvious and understandable, the specific implementations of the present invention will be described in detail below with reference to the accompanying drawings of the specification.

Many specific details are set forth in the following description to fully understand the present invention. However, the present invention can also be implemented in other ways different from those described here. Those skilled in the art can do similar promotion without departing from the connotation of the present invention, and therefore the present invention is not limited to the specific embodiments disclosed below.

Second, reference herein to "one embodiment" or "embodiment" refers to a specific feature, structure, or characteristic that may be included in at least one implementation of the present invention. "In one embodiment" appearing in different places in this specification does not all refer to the same embodiment, nor is it a separate or selective embodiment that is mutually exclusive with other embodiments.

Embodiment 1

Referring to FIG. 1 to FIG. 6, a first embodiment of the present invention is shown. This embodiment provides a comprehensive multifunctional fitness cabinet. The comprehensive multifunctional fitness cabinet can be stored after the fitness is completed. The comprehensive multifunctional fitness cabinet specifically comprises a box 100 having a storage slot 110 on a top thereof; a seat assembly 200 comprising a backing plate 210 movably connected to the storage slot 110 and a seat plate 220 movably connected to the storage slot 110; a movement assembly 300 comprising a bracket 320 and a pull cord 370 connected to the bracket 320, a resistance member being connected to an end of the pull cord 370; and a support assembly 400 used to connect the box 100 and the seat assembly 200; wherein, the seat assembly 200, the movement assembly 300 and the support assembly 400 can all be stored in the storage slot 110.

In this embodiment, please refer to FIG. 2 to FIG. 5. The movement assembly 300 also comprises a mounting base 310 disposed in the storage slot 110. The mounting base 310 is rotatably connected to an end of the bracket 320. A telescopic rod 330 is rotatably connected to a top of the bracket 320. The telescopic rod 330 is of a hollow structure, which can be disposed in a vertical state and a horizontal state and be provided with a wire wheel 340.

Figure 4:
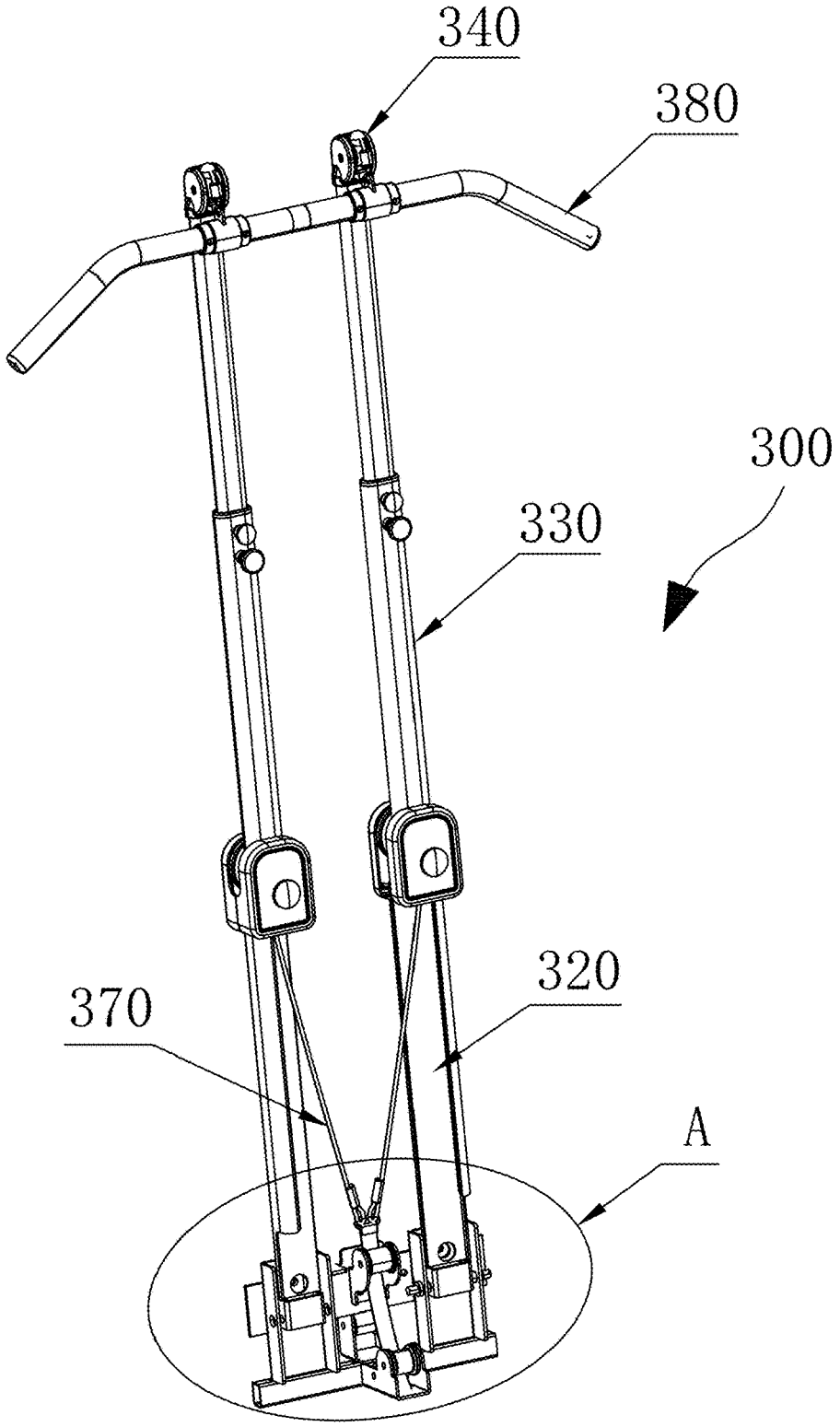
FIG. 4 is a schematic structural diagram of a movement assembly in FIG. 3 in the present invention.
Figure 5:
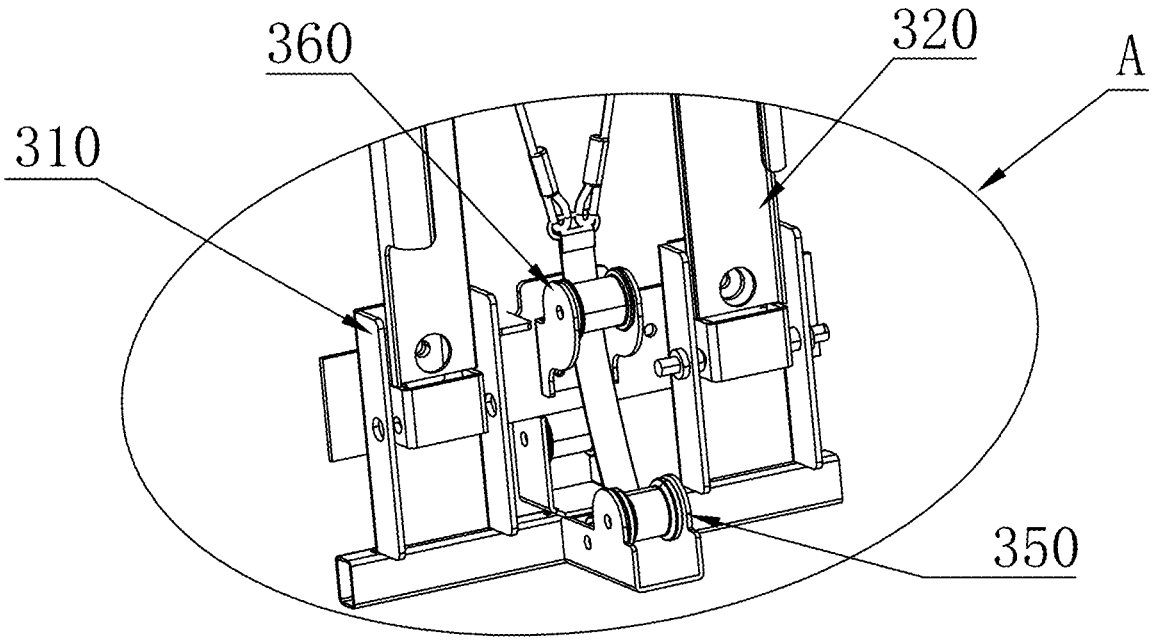
FIG. 5 is an enlarged view of part A in FIG. 4 in the present invention.

Please refer to FIG. 4 to FIG. 5. In this embodiment, the resistance member comprises a connecting frame 360 connected to the mounting base 310, a guide wheel set 350 connected to the connecting frame 360, and webbing wound around the guide wheel set 350. One end of the pull cord 370 passes through an inner cavity of the telescopic rod 330 and is connected to a holding member through the wire wheel 340. The other end of the pull cord 370 is connected to the webbing. The resistance member also comprises but is not limited to an electromagnet, a magnetic resistor, a motor and other products that can generate resistance.

The specific usage process of this embodiment is as follows: a user sits on the seat plate 220, leans back on the backing plate 210, and pulls the pull cord 370 through the holding member to stretch the webbing to perform fitness exercises. It is worth noting that the holding member is preferably a segmented pull rod 380 and a pull ring 390, and the pull rod 380 and the pull ring 390 are both covered with anti-slip covers.

Embodiment 2

Figure 6:
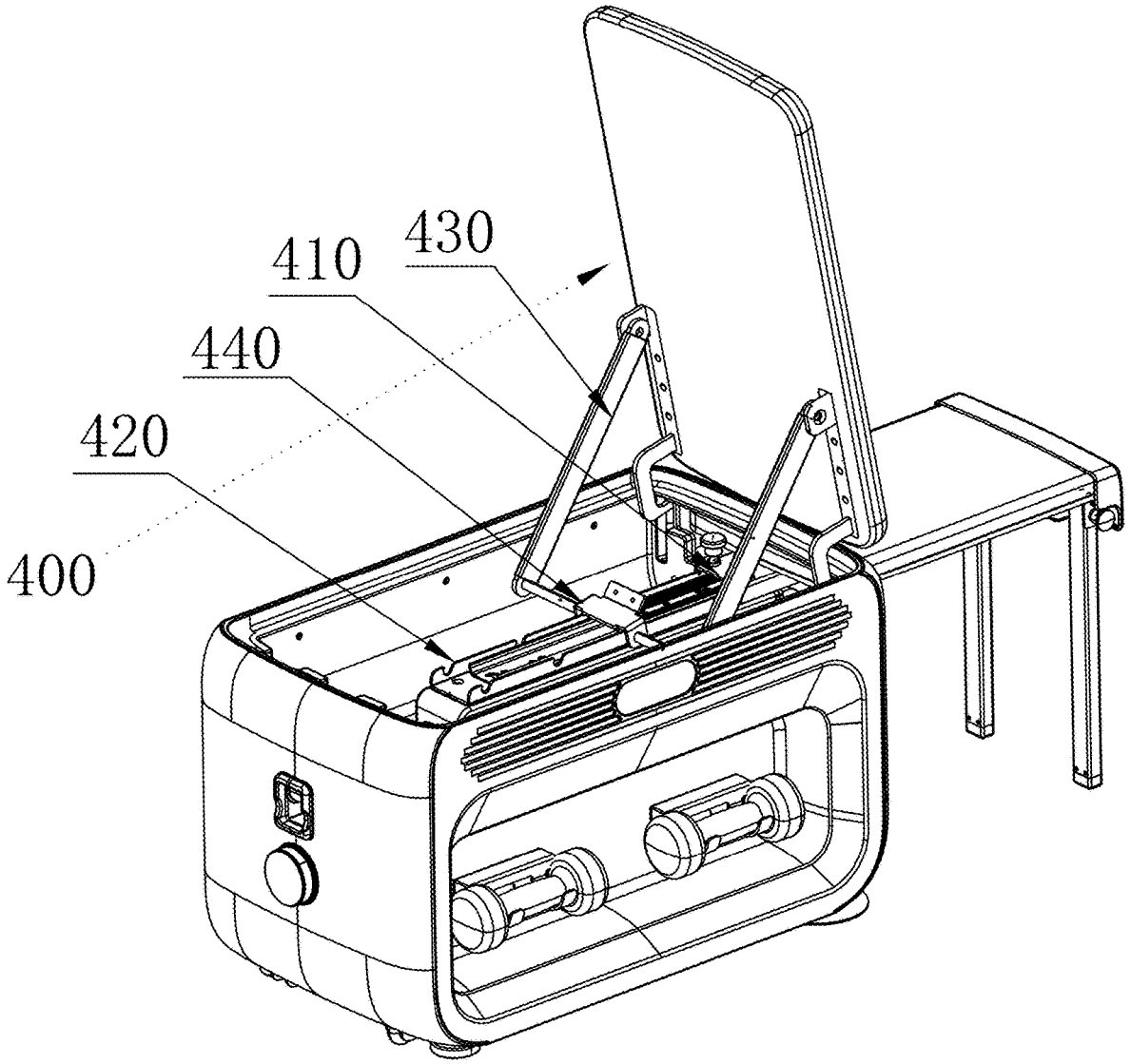
FIG. 6 is a schematic structural diagram of a support assembly in the present invention.

Referring to FIG. 6, a second embodiment of the present invention is shown. This embodiment is based on the previous embodiment. The difference is that a connection mode between the seat assembly 200 and the box 100 is provided. Specifically, The support assembly 400 comprises a slide block 410 disposed at a bottom of the seat plate 220 and a slide rail 420 disposed at a bottom of the storage slot 110. The seat plate 220 is slidably connected to the storage slot 110 through cooperation of the slide block 410 and the slide rail 420.

Further, the support assembly 400 further comprises connecting rods 430 disposed symmetrically on both sides of a side wall of the backing plate 210 and rotatably connected to the backing plate 210, and a crossbar 440 is connected between ends of the two connecting rods 430.

The specific usage process of this embodiment is as follows: through the cooperation of the slide block 410 and the slide rail 420, the seat plate 220 and the box 100 are separated and combined. The separation and combination of the backing plate 210 and the box 100 are achieved through the connecting rods 430 and the crossbar 440 connected between the ends of the two connecting rods 430.

It is worth noting that in this embodiment, a plurality of positioning openings are disposed on a top of the slide rail 420, the crossbar 440 can be embedded in the positioning openings, and the legs 230 are disposed at a bottom of one end of the seat plate 220 away from the box 100 and are rotatably connected to the seat plate 220. Specifically, when the backing plate 210 is separated from the box 100, an angle of the backing plate 210 can be adjusted by embedding the crossbar 440 in different positioning openings, thereby improving the comfort during fitness exercises.

Embodiment 3

Referring to FIG. 6, a third embodiment of the present invention is shown. This embodiment is based on the previous embodiment. Specifically, both sides of the box 100 are provided with a storage cavity 120, and a storage rack is disposed in the storage cavity 120, in which a dumbbell, the pull rod 380 and the pull ring 390 can be accommodated, and the bottom of the box 100 is provided with feet and moving wheels, and the feet are distributed at four corners of the bottom of the box 100.

Embodiment 4

Figure 7:
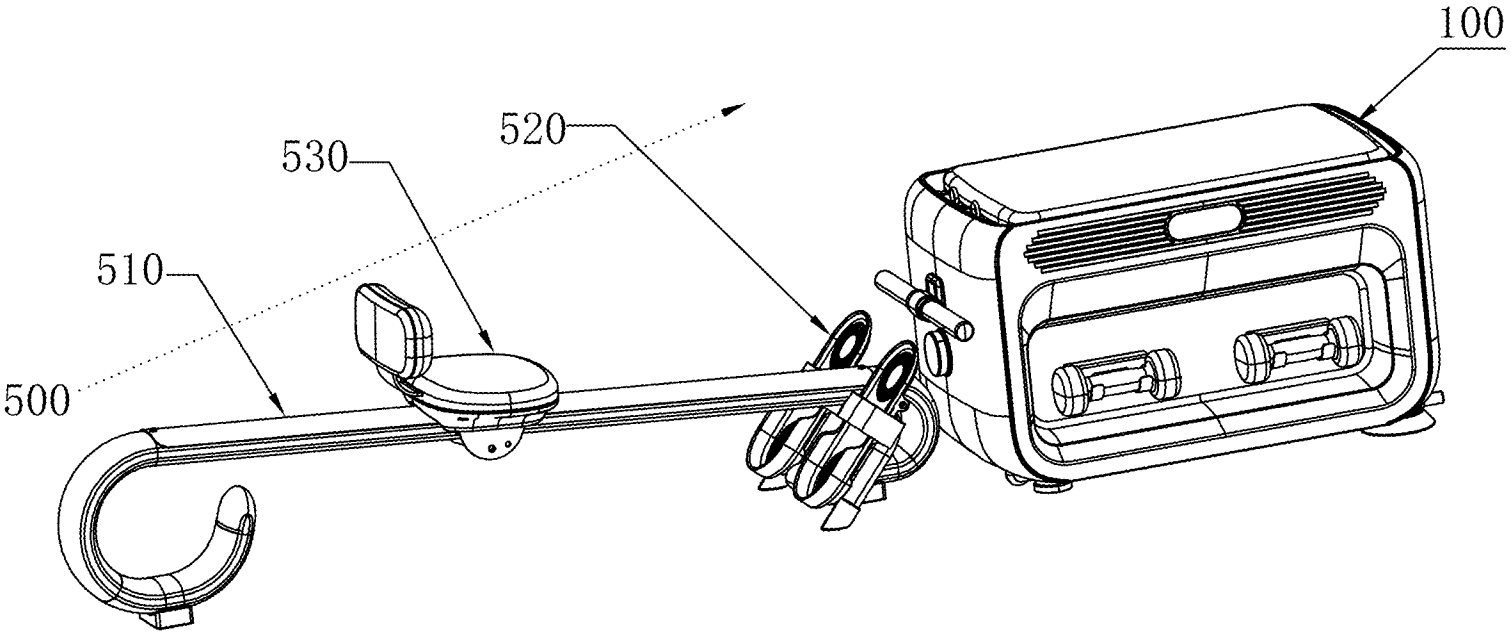
FIG. 7 is a schematic structural diagram of cooperation of a box and a slide seat assembly in the present invention.

Referring to FIG. 7, a fourth embodiment of the present invention is shown. This embodiment is based on the previous embodiment. Specifically, the comprehensive multifunctional fitness cabinet further comprises a slide seat assembly 500. The slide seat assembly 500 comprises a support seat 510 disposed on the ground. A foot pedal 520 is disposed at one end of the support seat 510, and a seat cushion 530 is slidably disposed on the support seat 510. The specific usage process of this embodiment is as follows. The user sits on the seat cushion 530, puts two feet on the foot pedal 520, and holds a pull bar on the side wall of the box 100 with both hands (the pull bar is fixedly connected to the webbing inside the box 100). That is, corresponding stretching training can be carried out.

Figure 2:
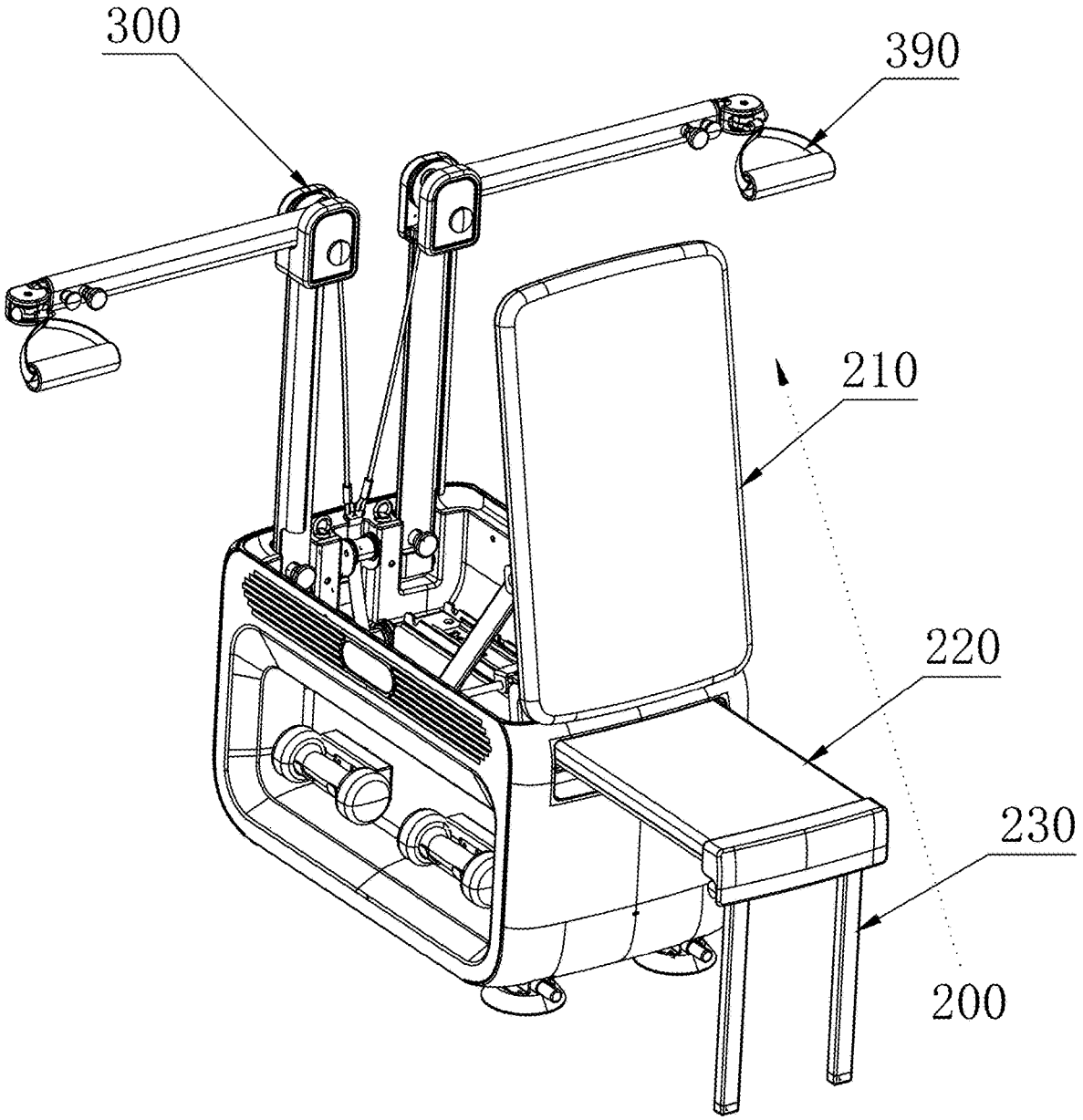
FIG. 2 is a schematic diagram of a first open state of an overall structure in the present invention.
Figure 3:
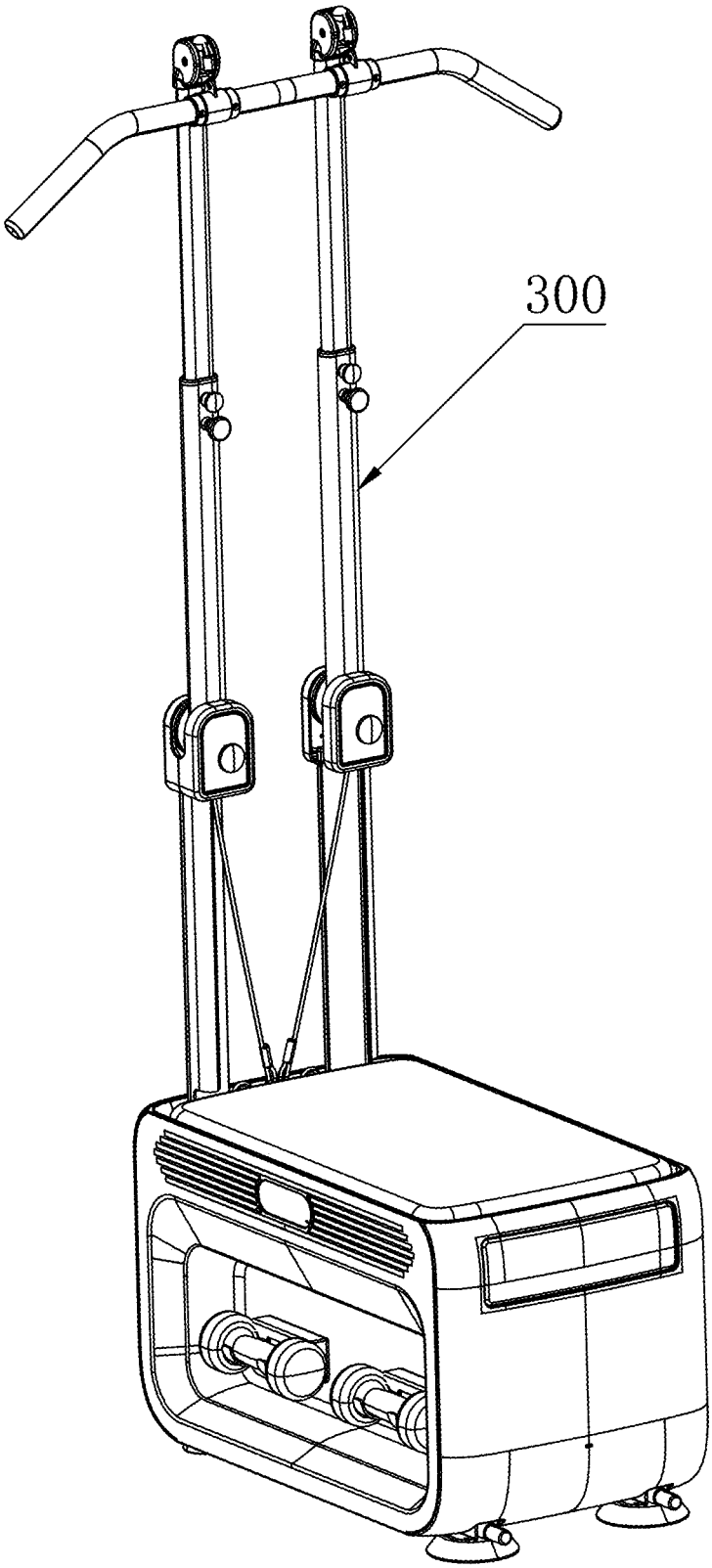
FIG. 3 is a schematic diagram of a second open state of an overall structure in the present invention.

Working Principle:

First, the fitness cabinet in a state shown in FIG. 1 is moved to a fitness area, the seat plate 220 and the backing plate 210 are separated from the same, and the crossbar 440 is embedded in different positioning openings to adjust the angle of the backing plate 210, as shown in FIG. 2. The movement assembly 300 is assembled to a state shown in FIG. 2. Specifically, the user sits on the seat plate 220, leans back against the backing plate 210, puts two feet on the ground, grasps the pull ring 390 with both hands, keeps the body stable, and then stretches the pull cord 370. The pull cord 370 pulls the webbing to generate resistance, and the pull ring 390 is pulled to perform chest-clamping and fly movement training. As shown in FIG. 3, the user can also sit on the box 100, grab the pull rod 380 with both hands, and pull the pull rod 380. The pull cord 370 pulls the webbing to generate resistance, thereby completing the fly movement training. As shown in FIG. 6, the user sits on the seat plate 220 and leans on the backing plate 210, and takes out the dumbbell for exercise, thereby realizing the function of a dumbbell bench. As shown in FIG. 7, the user sits on the seat cushion 530, puts two feet on the foot pedal 520, and holds the pull bar on the side wall of the box 100 with both hands, and the pull cord 370 pulls the webbing to generate resistance to perform rowing movement training. The movement assembly 300 is assembled to a state in FIG. 3 to perform different movement exercises. The user can also support the box 100 with both hands to perform push-up training and plank arm flexion and extension training, or can perform yoga movement training on the box 100 in a kneeling position. The seat cushion 530 can also be moved to one end close to the foot pedal 520, so that the user can lie on the support seat 510 to perform sit-up training, etc., and can also perform training for two people at the same time.

When storage is required, the telescopic rod 330 is rotated, the bracket 320 is rotated around the mounting base 310 to store the movement assembly 300 in the storage slot 110, and the seat assembly 200 is stored. The comprehensive multifunctional fitness cabinet is stored again to the state shown in FIG. 1. This further improves the portability of the fitness cabinet.

It is important to note that the construction and arrangements of the present application shown in various exemplary implementations are illustrative only. Although only a few implementations are described in detail in this disclosure, those reviewing this disclosure will readily appreciate that many modifications are possible without materially departing from the novel teachings and advantages of the subject matter described in this application (e.g. changes in size, scale, structure, shape and proportion of various elements, as well as parameter values (e.g. temperature, pressure, etc.), mounting arrangements, use of materials, colors, orientations, etc.). For example, an element shown as integrally formed may be constructed from a plurality of parts or elements, the position of elements may be inverted or otherwise altered, and the nature or number or position of discrete elements may be altered or varied. Accordingly, all such modifications are intended to be included within the scope of the present invention. The order or sequence of any process or method steps may be changed or reordered according to alternative implementations. In the claims, any "means-plus-function" clause is intended to cover the structures described herein as performing the recited function, not only structural equivalents but also equivalent structures. Other substitutions, modifications, changes and omissions may be made in the design, operation and arrangement of the exemplary implementations without departing from the scope of the present invention. Therefore, the present invention is not limited to particular implementations, but extends to various modifications which still fall within the scope of the appended claims.

Furthermore, in order to provide a concise description of the exemplary implementations, not all features of an actual implementation may be described (i.e., those features that are not relevant to the best mode presently contemplated for carrying out the present invention, or that are not relevant to carrying out the present invention).

It is understood that numerous specific implementation decisions may be made during the development of any actual implementation, as in any engineering or design project. Such a development effort might be complex and time consuming, but would be a routine undertaking of design, manufacture and production without undue experimentation to those of ordinary skill having the benefit of this disclosure.

It should be noted that the above embodiments are only used to illustrate the technical solutions of the present invention rather than to limit it. Although the present invention has been described in detail with reference to the preferred embodiments, those of ordinary skill in the art should understand that modifications or equivalent substitutions can be made to the technical solutions of the present invention without departing from the spirit and scope of the technical solutions of the present invention, which shall be included in the scope of the claims of the present invention.

What is claimed is:

1. A comprehensive multifunctional fitness cabinet, comprising:

a box having a storage slot on a top thereof;

a seat assembly comprising a backing plate movably connected to the storage slot, and a seat plate movably connected to the storage slot;

a movement assembly comprising a bracket and a pull cord connected to the bracket, and a resistance member being connected to an end of the pull cord; and a support assembly used to connect the box and the seat assembly;

wherein the seat assembly, the movement assembly and the support assembly can all be stored in the storage slot;

wherein the movement assembly further comprises a mounting base disposed in the storage slot, the mounting base is rotatably connected to an end of the bracket, and a telescopic rod is rotatably connected to a top of the bracket, the telescopic rod is of a hollow structure, which can be disposed in a vertical state and a horizontal state and be provided with a wire wheel on a top.

2. The comprehensive multifunctional fitness cabinet according to claim 1, wherein the resistance member comprises a connecting frame connected to the mounting base, a guide wheel set connected to the connecting frame, and webbing wound around the guide wheel set, one end of the pull cord passes through an inner cavity of the telescopic rod and is connected to a holding member through the wire wheel, and the other end of the pull cord is connected to the webbing.

3. The comprehensive multifunctional fitness cabinet according to claim 2, wherein the support assembly further comprises connecting rods disposed symmetrically on both sides of a side wall of the backing plate and rotatably connected to the backing plate, and a crossbar is connected between ends of the two connecting rods.

4. The comprehensive multifunctional fitness cabinet according to claim 3, wherein a plurality of positioning openings are disposed on a top of the slide rail, and the crossbar can be embedded in the positioning openings.

5. The comprehensive multifunctional fitness cabinet according to claim 4, wherein the seat assembly further comprises legs, and the legs are disposed at a bottom of one end of the seat plate away from the box and are rotatably connected to the seat plate.

6. The comprehensive multifunctional fitness cabinet according to claim 1, wherein the holding member is a segmented pull rod and a pull ring, and the pull rod and pull ring are both covered with anti-slip covers.

7. The comprehensive multifunctional fitness cabinet according to claim 6, wherein both sides of the box are provided with a storage cavity, and a storage rack is disposed in the storage cavity, in which a dumbbell, the pull rod and the pull ring can be accommodated.

8. The comprehensive multifunctional fitness cabinet according to claim 7, wherein a bottom of the box is provided with feet and moving wheels, and the feet are distributed at four corners of the bottom of the box.

9. The comprehensive multifunctional fitness cabinet according to claim 2, wherein the support assembly comprises a slide block disposed at a bottom of the seat plate and a slide rail disposed at a bottom of the storage slot, and the seat plate is slidably connected to the storage slot through cooperation of the slide block and the slide rail.

* * * * *